US007098411B1

(12) United States Patent
McConnell et al.

(10) Patent No.: US 7,098,411 B1
(45) Date of Patent: Aug. 29, 2006

(54) ELECTRONIC MODULE FOR UNIVERSAL GARAGE DOOR OPENER AND ASSEMBLY METHOD

(75) Inventors: John E. McConnell, Ann Arbor, MI (US); Bruce Pierik, Hazel Park, MI (US); John Stack, Shelby Township, MI (US); Brian R. Masters, Hartland, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/275,036

(22) Filed: Dec. 5, 2005

Related U.S. Application Data

(63) Continuation-in-part of application No. 11/163,108, filed on Oct. 5, 2005.

(51) Int. Cl.
*H01H 9/00* (2006.01)

(52) U.S. Cl. ..... 200/5 R; 200/5 A; 200/310; 200/341; 341/22; 345/168

(58) Field of Classification Search ..... 200/5 A, 200/310, 312–314, 341–345, 5 R; 341/22; 345/168–169; 400/490–496
See application file for complete search history.

(56) References Cited

U.S. PATENT DOCUMENTS

| | | | | |
|---|---|---|---|---|
| 4,315,114 | A * | 2/1982 | Monti, Jr. | 200/5 A |
| 4,867,498 | A | 9/1989 | Delphia et al. | |
| 5,020,845 | A | 6/1991 | Falcoff et al. | |
| 5,927,483 | A * | 7/1999 | Yamada | 200/343 |
| 6,003,925 | A | 12/1999 | Litke et al. | |
| 6,126,221 | A | 10/2000 | Kern | |
| 6,388,559 | B1 | 5/2002 | Cohen | |
| 6,492,605 | B1 * | 12/2002 | Iida | 200/343 |
| 6,555,774 | B1 * | 4/2003 | Nielsen | 200/343 |
| 6,624,605 | B1 | 9/2003 | Powder et al. | |
| 6,964,532 | B1 * | 11/2005 | Lu | 400/490 |
| 2005/0002170 | A1 | 1/2005 | Jacobs et al. | |
| 2005/0017948 | A1 | 1/2005 | Nguyen et al. | |

* cited by examiner

*Primary Examiner*—K. Lee
(74) *Attorney, Agent, or Firm*—Brooks Kushman P.C.

(57) ABSTRACT

An electronic module that is activated by the touch of a button for sending a wireless signal to a remote receiver. The module has a housing with an upper portion that is secured in relation to a vehicle. A lower portion of the housing has mating apertures and openings provided therein. A set of staking posts extends from an upper face of one or more buttons. The staking posts have a leading end that is registrable with the mating apertures that are provided in the lower portion of the housing. A set of actuating posts also extends from the upper face of the button. Those posts extend within at least some of the openings that are defined in the lower portion of the housing. Optionally, an array of light pipes is in optical communication with a set of switches. One of the switches can be closed following contact by a leading end of one of the posts when a button is depressed. A printed circuit board is positioned in operative communication with one or more of the buttons so that upon touching a button, a circuit in the circuit board is closed by one of the switches. A signal is then sent wirelessly to a remote receiver.

16 Claims, 3 Drawing Sheets

ELECTRONIC MODULE FOR UNIVERSAL GARAGE DOOR OPENER AND ASSEMBLY METHOD

CROSS-REFERENCE TO RELATED APPLICATIONS

This application is a continuation-in-part of U.S. application Ser. No. 11/163,108, filed Oct. 5, 2005, which is incorporated herein by reference.

BACKGROUND OF THE INVENTION

1. Field of the Invention

The present invention relates to a button array and optionally a light pipe array for an electronic module that can be used to actuate a remote device (such as, but not limited to a garage door opener) and an assembly method, such as used in the interior trim of a vehicle.

2. Background Art

There are various situations in which it would be desirable to send a wireless signal to a receiver that is located remotely from a sending unit. For example, if the sending unit were located in a vehicle, there is technology presently available by which the sending unit can activate or de-activate an alarm system within a building or open and close a garage door.

Some electronic garage door openers, for example, can be located in a vehicle's overhead console. Ideally, in-vehicle transmitter arrangements are such that the transmitter can be accessible immediately. Preferably, such transmitters can be operated without removal from the vehicle. Some approaches call for attaching the transmitter in the ceiling area of the vehicle, while protecting the transmitter (and a vehicle occupant) from unwanted dislodging from the overhead location.

Among the art identified in a pre-filing search, are the following U.S. references: U.S. Pat. Nos. 4,867,498; 5,020,845; 6,003,925; 6,126,221; 6,624,605.

However, some prior art approaches are accompanied by a problem: buttons associated with the transmitter may tend to stick if there is improper alignment. It is known to use light pipes in such mechanisms and assemblies. Those light pipes permit guided transmission of light that emanates from a light source to, for example, an LED that illuminates when a circuit is closed. Conventionally, a light pipe is received in a housing by a snap fit. Assembly of multiple individual light pipes increases assembly costs and opportunities for assembly errors, misalignment, and reliability issues.

SUMMARY OF THE INVENTION

It would therefore be desirable to provide an apparatus and method wherein a light pipe array can be dropped into place and its registration assured by multiple posts or staking posts that are received predictably within multiple apertures or openings, thereby assuring a perfect fit without unwanted forces being involved.

One object of the present invention is to provide a fully assembled module with a button array that acts as a locator for the entire module to its respective trim bezel.

Relatedly, it is an object of the present invention to provide a button array wherein button positioning is relatively consistent.

Another object is to imbue such buttons with a tactile feel, together with accurate registration, while being relatively easy to assemble.

Further, it is an object of the invention to provide a button array and optional light pipe array that can readily be assembled to the module.

Relatedly, one object of this invention is to provide a one piece assembly that eliminates the sticking button problem associated with current multiple assembly designs and assures accurate registration of buttons to button openings.

One object of this invention is to provide a one piece assembly that eliminates the sticking button problem associated with current two piece assembly designs and assures accurate registration of buttons to button openings.

The present invention utilizes button arrays instead of using individual buttons, and light pipe arrays instead of individual light pipes for an electronic module, such as (but not limited to) a universal garage door opening module. Problems of improper alignment and consequent sticking of buttons and operation are avoided for the reasons that are described in more detail below. In one embodiment, a button array is associated with the universal garage door opening module, thereby eliminating alignment and sticking button issues.

Additionally, the light pipe array reduces assembly issues that are associated with having multiple individual components, compared to having one array.

Thus, the invention includes an electronic module that is activated by the touch of a button for sending a wireless signal to a remote receiver. The module has a housing with an upper portion that is secured in relation to a vehicle. A lower portion of the housing has mating apertures and openings provided therein.

A set of switch actuation posts extend from an upper face of one or more buttons. The posts have a leading end that is registrable with the mating apertures that are provided in the lower portion of the housing.

A set of posts also extends from the upper face of the button. Those actuation posts extend within at least some of the openings that are defined in the lower portion of the housing.

Preferably, an array of annunciators, such as light pipes is secured to the upper face of the lower portion of the housing. The array of light pipes is in electronic communication with a set of switches. One of the switches can be closed following contact by a leading end of one of the posts when a button is depressed. A LED illuminates when a switch is closed by depressing a button. The light from the LED is transmitted through the respective light pipe providing a visible indication that the switch was activated.

A printed circuit board is positioned in operative communication with one or more of the buttons so that upon touching a button, a circuit in the circuit board is closed by one of the switches. A signal is then sent wirelessly to a remote receiver.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
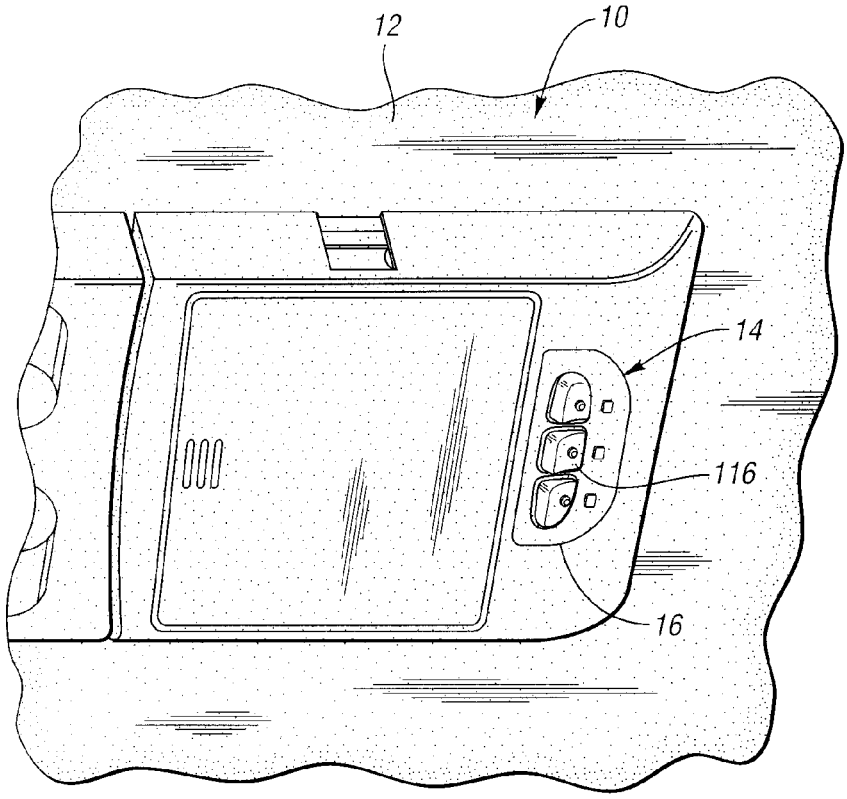
FIG. 1 is a perspective view of an exemplary electronic module disposed on an interior trim component of a vehicle.

Referring to FIG. 1, an interior trim component 10 for a vehicle is shown. The interior trim component 10 may be of any suitable type, such as a trim panel like a door module or an instrument panel. In the embodiment shown, the interior trim component 10 is configured as a console that may be disposed proximate a headliner 12 of the vehicle.

The interior trim component 10 may include an electronic module 100 (FIG. 2) for controlling the operation of another device. For example, the module 100 may be adapted to remotely control at least one device, such as a garage door opener or a security system. Of course, the present invention also contemplates embodiments in which one or more devices are not remotely controlled. For instance, the module 100 be associated with a vehicle electrical system and may be electrically connected to one or more vehicular components.

Figure 2:
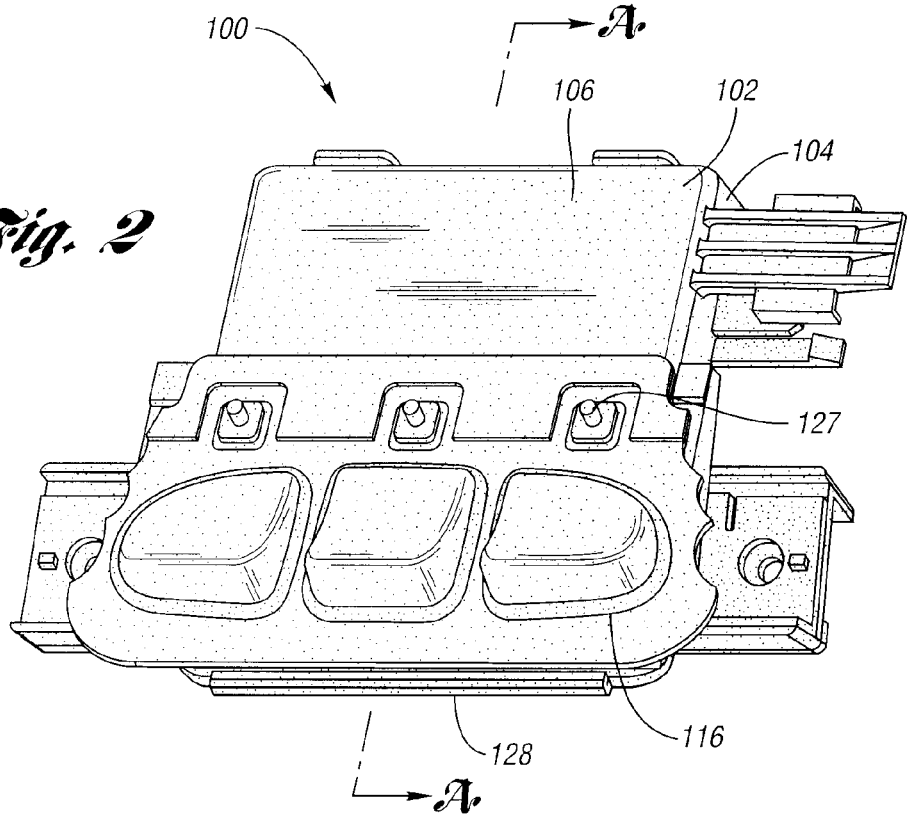
FIG. 2 is a more detailed perspective view of the module shown in FIG. 1.

As shown in FIGS. 1–2, the module 100 may be partially concealed by a cover plate or bezel 16. The bezel 16 may include one or more openings through which buttons 116 and/or light pipes 124 (FIGS. 4–5) of the module 100 may at least partially extend.

Figure 3:
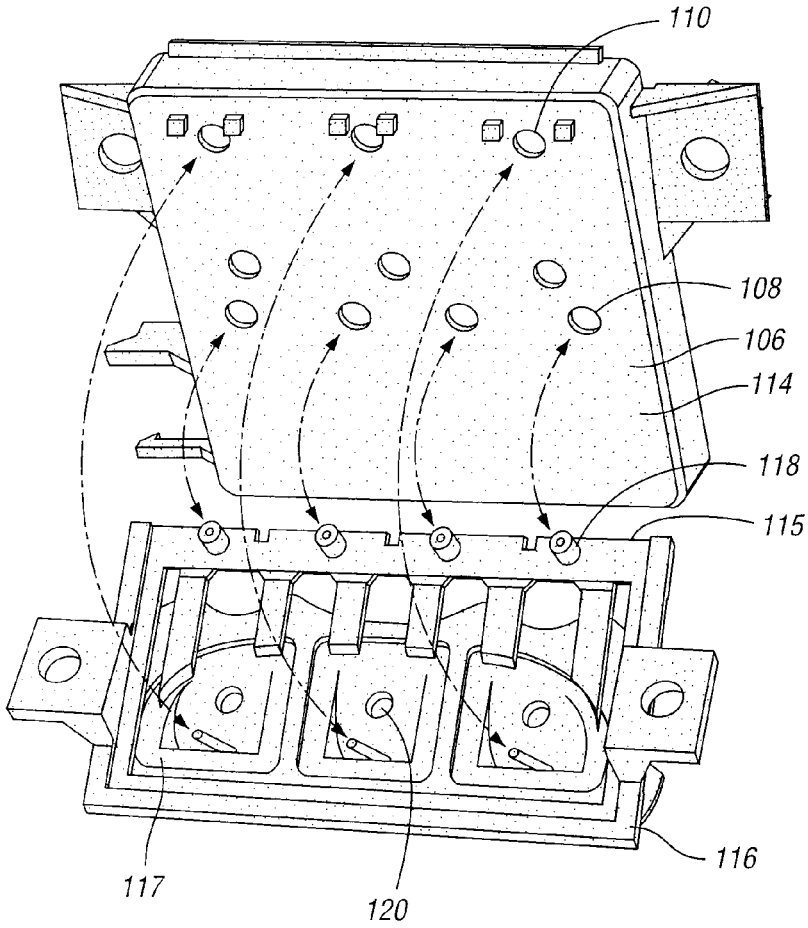
FIG. 3 is an exploded view of a unitary button array and module housing shown in FIG. 2.
Figure 4:
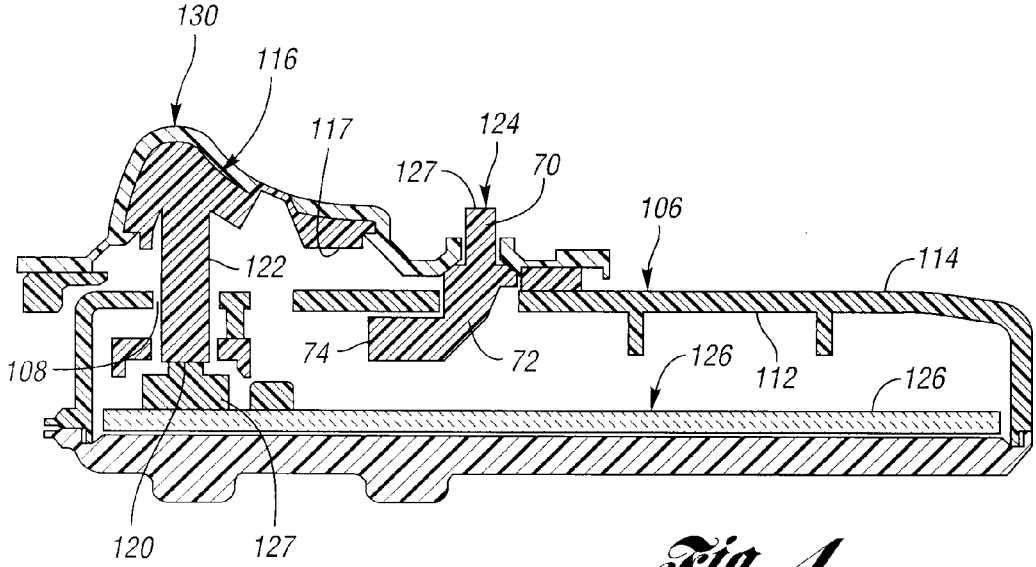
FIG. 4 is a section view of the module along section line A—A shown in FIG. 2.

Referring to FIGS. 2–4, the module 100 is shown in more detail. As used herein, the terms "upper" and "lower" describe a component's orientation in relation to the electronic module 100 in its installed position, one of which is depicted in FIG. 1. The module 100 has a housing 102 that in one embodiment has an upper portion which is secured in relation to a vehicle. A lower portion 106 of the housing 102 has mating apertures 108 (FIG. 3) and openings 110 provided therein. An upper face 112 and a lower face 114 at least partially defines the lower portion 106 of the housing 102.

One or more buttons 116 or means for actuating also are provided in the electronic module 100. The one or more buttons 116 have an upper face 117 (FIG. 3).

In one embodiment, a set of staking posts 118 or means for positioning extends from the upper face 117 of the one or more buttons 116. Preferably, the staking posts 118 are registrable with one or more of the mating apertures 108. In this way, the upper face 117 of the one or more buttons 116 is securely and predictably positioned in relation to the lower portion 106 of the housing 102. Thus, the problems of buttons sticking and misalignment are minimized or avoided.

A set of posts 122 or means for contacting also extends from the upper face 117 of the one or more buttons 116. These posts 122 are located within openings 110 that are defined in the lower portion 106 of the housing.

Secured to the upper face 112 of the lower portion 106 of the housing is an array of light pipes for means of transmitting light 124 (only one pipe is shown in FIG. 4). In one embodiment (e.g., FIG. 5), there are three such light pipes integrally molded into one light pipe array. These pipes serve the function of transmitting or guiding light so that upon closure of an electrical circuit, an annunciator, such as a light-emitting diode, is visible outside the array of buttons 116 (e.g. at 70, FIG. 4).

A printed circuit board 126 includes one or more switches (not shown) that are positioned in operative communication with one of the one or more buttons 116. Upon touching a button, a switch in the circuit board 126 is closed following contact by the leading end 120 of one of the set of posts 122 when one of the buttons 116 is depressed. Then, a signal is sent wirelessly to the remote receiver.

In one embodiment, a living hinge 128 connects the upper 104 and lower 106 portions of the housing 102. It will be appreciated that the portions 104, 106 can also be united by a conventional hinge, or a hook and pin assembly, or other means for joining.

In one embodiment, a tactile surface 130 (see, e.g., FIG. 2) is provided over at least one of the buttons 116 (see, e.g., FIG. 5) to imbue a button with a soft touch feel.

As indicated earlier, in alternate embodiments, the remote receiver may be a garage door opener and will be associated with a security system.

Clearly, the electronic module may in some applications include only one button 116, but preferably there are multiple buttons. Relatedly, the set of posts 118 are but one example of means for positioning and securing the buttons 116 with respect to the housing 102. There are other attachment methods, including using an adhesive, vibration welding, sonic welding, screws, and mechanical snaps or with one or more retaining features in various alternate embodiments of the present invention.

Similar comments are applicable to the set of posts 122. Preferably, there are three posts 122 in the set. The set is exemplary of means for contacting one or more switches in the printed circuit board 126 through the openings 110 in the lower portion 106 of the housing 102.

In one embodiment, there are three buttons 116 and three actuating posts 122—one actuating post per button.

The array of light pipes 124 is one specie of means for transmitting light. There are other such means, including mirror system and other reflecting and optically conducting means, including optical fibers, and the like.

Preferably, an indicator or annunciator 127 is provided in optical communication with at least one in the array of light pipes. The indicators illuminate when a button has been activated and a signal has been sent to the remote device. The indicator could provide an aural signal either alternatively, or in addition to visual indication.

The housing 102 may also include one or more grooves that inhibit unwanted transmission of light. For example, at least one groove may be provided that inhibits light transmission from a light source to a light pipe not associated with the light source. As such, a light pipe may be generally isolated from light sources not associated with the light pipe so that the light pipe does not illuminate when a non-associated light source is illuminated. In one embodiment, there are two grooves that inhibit the transmission of light between three light pipes. More specifically, the grooves inhibit light transmission from a light source associated with the center light pipe to the other light pipes and vice versa. The grooves may have any suitable configuration.

Figure 5:
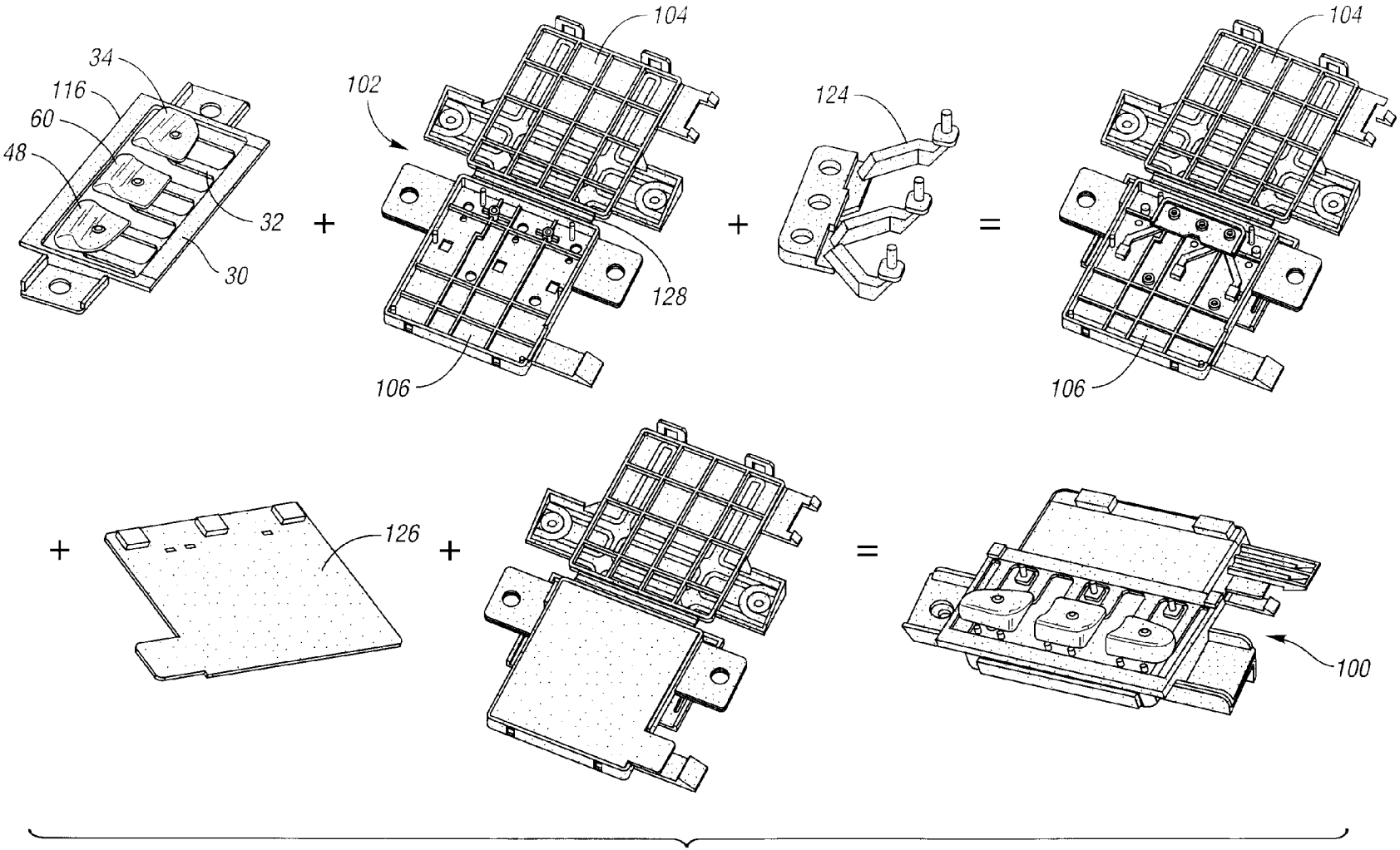
FIG. 5 is a depiction of the assembly sequence of the electronic module.

In one embodiment, the button assembly 116 may rise or fall about an edge thereof 115 in a hingedly-connected manner. Here, the bias is to the opened state. Optionally, one or more flexible cantilever arms extend from the frame 30 of the buttons 116. In the embodiment of FIG. 5, the arms 32 extend from the frame 30 into the opening 48. One or more arms 32 may be associated with a button 34 and may flex when sufficient force is applied to the button 34. The arms 32 may have any suitable configuration. In the embodiment shown in FIG. 5, two generally parallel and planar arms 32 are associated with each button 34. The arms 32 may be provided in various lengths, thicknesses, and configurations to provide a desired amount of flexibility. In the embodiment shown, three buttons 34 are shown, such that each button 34 extends from a pair of flexible cantilever arms 32. Each button 34 may be associated with a switch as described earlier. The buttons 34 may have any suitable configuration. In the embodiment shown, each button 34 has a body 60 and an actuating post 122.

The body 60 may be at least partially disposed above the opening 48 and/or the frame 30. The body 60 may have a contoured upper surface and a lower surface. The upper surface may also include a tactile feature that extends from the upper surface. The tactile feature and/or the body 60 may be configured to illuminate or provide backlighting when light is provided. In at least one embodiment, illumination may be provided by a light source not associated with a light pipe.

The one or more light pipes 124 are adapted to internally transmit light. In the embodiment shown, each light pipe 36 is associated with a light source. The light pipes may have any suitable configuration. In the embodiment of FIG. 4, each light pipe includes a first end portion 70, a connecting portion 72, and a second end portion 74. Of course, the present invention also contemplates numerous other configurations, as well as embodiments in which one or more of these portions are omitted.

The first end portion 70 may be adapted to receive light from an associated light source. In the embodiment shown, the first end portion 70 is at least partially disposed between an associated button and the frame and extends below and generally perpendicular to the lower surface of the frame. The first end portion 70 may also extend through a light pipe aperture in the housing 22. In addition, the present invention also contemplates embodiments in which the first end portion 70 is omitted and light is provided directly to the connecting portion 72.

One or more switches 127 and one or more light sources may be provided. Each light source may be configured to illuminate when an associated switch is actuated. In the embodiment shown, a plurality of switches and light sources are disposed on a substrate, such as a printed circuit board 126. The circuit board 126 is disposed in the upper or lower portion 104, 106 of the housing 102. The switches may be of any suitable type, such as mechanical switches, proximity switches or combinations thereof. Similarly, the light sources may be of any suitable type, such as a light emitting diode (LED), incandescent bulb, or combinations thereof. Alternatively, the switches and light sources may be provided as separate components that are not disposed on a substrate in at least one embodiment of the present invention. If a substrate is provided, it may be attached to the housing in any suitable manner, such as with one or more retaining features or an adhesive. Moreover, the substrate may include electronics for controlling and/or communicating with another component, such as a garage door opener.

As shown in FIG. 5, the electronic module 100 may be assembled in any suitable manner. One way is as follows:

1. Place button array 116 face down into a locating nest;

2. Place housing 102 over the button array 116 and next the housing 02 to the button array 116;

3. Place light pipe array 124 into housing 102 and locate;

4. Attach the button array 116 and the light pipe array 12 (e.g., by using hot air cold upset staking process) or other attachment methods;

5. Place PCB 126 into housing 102; and

6. Fold housing upper and lower portions 104, 106 to close and secure snap locks.

The present invention discloses an electronic module with fewer individual components, thereby reducing manufacturing and assembly costs as well as the complexity associated with handling and assembling small individual components, such as buttons and light pipes. In addition, the present invention allows various features to be provided on at least one unitary part to establish reliable feature orientation and alignment. Moreover, in at least one embodiment of the present invention, light pipes may be optically isolated from other light pipes and/or light sources, thereby providing desired illumination and visual feedback to the user.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electronic module that is actuated by the touch of a button for sending a wireless signal to a remote receiver, the module having a housing having an upper portion that is secured in relation to a vehicle and a lower portion that has mating apertures and openings provided therein, the lower portion having an upper face and a lower face;

one or more buttons, the one or more buttons having an upper face;

a set of staking posts extending from the upper face of the one or more buttons, the posts each having a leading end and being registrable with the mating apertures, thereby positioning the upper face of the one or more buttons with the lower portion of the housing;

a set of actuating posts also extending from the upper face of the one or more buttons, the set of actuating posts extending within the openings defined in the lower portion of the housing; and a printed circuit board including one or more switches positioned in operative communication with one of the one or more buttons so that upon touching a button, a switch in the circuit board is closed following contact by the leading end of one of the set of actuating posts when one of the one or more buttons is depressed, a signal is sent wirelessly to the remote receiver, and an annunciating signal is communicated to an operator of the module.

2. The electronic module of claim 1, further comprising a living hinge that connects the upper and lower portions of the housing.

3. The electronic module of claim 1, further comprising a tactile surface associated with at least one of the buttons in the one or more buttons to imbue the at least one button array with a soft touch feel.

4. The electronic module of claim 1 wherein the remote receiver is a garage door opener.

5. The electronic module of claim 1 wherein the remote receiver is associated with a security system.

6. The electronic module of claim 1 wherein the one or more buttons comprise three buttons.

7. The electronic module of claim 1 wherein the set of staking posts comprises four posts.

8. The electronic module of claim 1 wherein the set of actuating posts comprises three posts.

9. The electronic module of claim 1 wherein there are three buttons and three actuating posts.

10. The electronic module of claim 1, further comprising an indicator showing that a button has been activated and that a signal has been sent to the remote device.

11. The electronic module of claim 1, wherein the array of buttons is provided with a textured surface.

12. The electronic module of claim 1, further including an array of light pipes that is secured to the upper face of the lower portion of the housing.

13. An electronic module that is actuated by the touch of a button for sending a wireless signal to a remote receiver, the module having a housing having an upper portion that is secured in relation to a vehicle and a lower portion that has mating apertures and openings provided therein, the lower portion having an upper face and a lower face;

one or more means for actuating, the means for actuating having an upper face;

means for positioning the means for actuating with respect to a housing, the means for positioning extending from the upper face of the means for actuating, the means for positioning having a leading end and being registrable with the mating apertures, thereby positioning the upper face of the means for actuating with the lower portion of the housing;

means for contacting a switch also extending from the upper face of the means for actuating, the means for contacting extending within the opening as defined in the lower portion of the housing;

means for transmitting an annunciating signal, the means for transmitting being secured to the upper face of the lower portion of the housing; and a printed circuit board positioned in operative communication with the means for actuation so that when such means are actuated, the circuit in the circuit board is closed and a signal is sent wirelessly to the remote receiver.

14. A method for assembling an electronic module that is actuated by the touch of a button for sending a wireless signal to a remote receiver, the method comprising the steps of:

A. placing a button array face down into a locating nest;

B. placing a housing over the button array and nesting the housing to the button array;

C. placing a light pipe array into the housing and locating the light pipe array therewithin;

D. staking the button array and the light pipe array;

E. placing a printed circuit board into the housing; and

F. folding the housing, securing it in a closed position.

15. The method of claim 14, wherein step D comprises using a hot air cold upset staking process.

16. The method of claim 14, wherein step F comprises curing the closed and folded housing by using snap locks.

* * * * *